US006384724B1

(12) United States Patent
Landais

(10) Patent No.: US 6,384,724 B1
(45) Date of Patent: May 7, 2002

(54) SMOKE ALARM

(76) Inventor: Andre M Landais, 567 E. 88th St., Brooklyn, NY (US) 11236

( * ) Notice: Subject to any disclaimer, the term of this patent is extended or adjusted under 35 U.S.C. 154(b) by 0 days.

(21) Appl. No.: 09/471,068

(22) Filed: Dec. 22, 1999

(51) Int. Cl.[7] ..... G08B 1/08; G08B 5/00

(52) U.S. Cl. ..... 340/531; 340/539; 340/540; 340/691.1; 340/691.6; 340/331; 340/332; 340/7.6; 340/407.1

(58) Field of Search ..... 340/539, 531, 340/540, 691.1, 691.6, 7.6, 7.58, 7.61, 825.19, 331, 332, 407.1, 572.1

(56) References Cited

U.S. PATENT DOCUMENTS

| | | | | | |
|---|---|---|---|---|---|
| 4,531,114 | A | * | 7/1985 | Topol et al. | 340/539 |
| 5,019,805 | A | * | 5/1991 | Curl et al. | 340/628 |
| 5,771,001 | A | * | 6/1998 | Cobb | 340/539 |
| 5,867,105 | A | * | 2/1999 | Hajel | 340/691.3 |
| 6,218,958 | B1 | * | 4/2001 | Eichstacdt et al. | 340/825.46 |
| 6,249,221 | B1 | * | 6/2001 | Reed | 340/539 |

* cited by examiner

*Primary Examiner*—Donnie L. Crosland
(74) *Attorney, Agent, or Firm*—Michael I Krol

(57) ABSTRACT

An alarm system for alerting persons within a monitored area as to an emergency situation. The alarm system includes a monitoring unit strategically placed within said monitored area, a vibrating unit and alighting system. The monitoring unit includes a sensor for sensing conditions within the monitored area and generating a sensor signal, a processor for analyzing the sensor signal to determine if an emergency situation exists and a transmitter for transmitting an emergency signal upon a determination that an emergency situation exists by the microprocessor The vibration unit is retained by a person within the monitored area including a receiver for receiving the emergency signal and a vibrator activated by the receiver for causing the vibrating unit to vibrate thereby alerting the person retaining the vibrating unit as to the emergency situation. The light system is positioned within the monitored area for receiving the emergency signal and illuminating a path to safety for persons within the monitored area. The monitoring unit can also include an audible alarm generator for generating an audible alarm signal and an LED connected to said microprocessor for generating a visual alarm signal upon a determination by the microprocessor that an emergency situation exists.

22 Claims, 6 Drawing Sheets

SMOKE ALARM

This application is subject to Disclosure Document No. 449857 filed Jan. 15, 1999.

BACKGROUND OF THE INVENTION

1. Field of the Invention

The present invention relates generally to alarms and, more specifically, to a smoke alarm including an emergency light for lighting an escape path and able to communicate with both a lighting system for directing persons to an exit and a vibrating device to be held by a person within the structure being monitored by the alarm, the light system and vibrator device being activated upon sensing of an alarm condition.

2. Description of the Prior Art

Numerous types of smoke alarms have been provided in the prior art. For example, U.S. Pat. Nos. Des. 3 60,156; 4,570,155; 5,587,705; 5,786,767 and 5,867,105 all are illustrative of such prior art. While these units may be suitable for the particular purpose to which they address, they would not be as suitable for the purposes of the present invention as heretofore described.

U.S. Pat. No. Des. 360,156

Inventor: Kenneth R. Fenne

Issued: Jul. 11, 1995

This patent illustrates an ornamental design for a combined strobe light and smoke detector.

U.S. Pat. No. 4,750,155

Inventor: John S. Skarman et al.

Issued: Feb. 11, 1986

A portable light for emergency illumination which is activated in response to the sound emitted by a smoke alarm device, which light has an efficient and reliable battery conserving circuit. The present light includes a switch interconnecting a battery and a light bulb for selectively activating the light bulb and a circuit interconnecting a microphone and the switch for selectively activating the switch in response to a smoke alarm signal. A strobe circuit interconnects the source of power and the circuit for periodically activating the circuit which, therefore, draws power for only a small fraction of the time.

U.S. Pat. No. 5,587,705

Inventor: Gary J. Morris

Issued: Dec. 24, 1996

The battery powered smoke detector of the present invention is designed to provide an early warning of the presence of an environmental condition of fire or smoke to persons in remote areas of a building with respect to the location of the environmental condition. The smoke detector sensing the environmental condition emits an audible alarm of continuous tone, while emitting a frequency modulated radio signal directly to other like smoke detectors to activate their alarms in a manner indicative of the location of the smoke detector sensing the environmental alarm condition. Rechargeable light modules separate from the smoke detector are included that receive the frequency modulated radio signal from the smoke detector sensing the environmental alarm condition and illuminate paths of egress for the duration of the alarm condition or in case of 120 VAC power failure. All components of the system are easy to install due to the modular design and conventional power sources. An intermittent activation of the frequency modulated receiving circuitry in the smoke detector unit conserves battery energy.

U.S. Pat. No. 5,786,767

Inventor: Joseph Severino

Issued: Jul. 28, 1998

A home safety system comprising a smoke detector, a carbon monoxide detector and a microphone connected to a transmitter. The smoke detector is powerable by a/c current and by a battery, and comprises a sensor for sensing smoke connected to an audible alarm signal. The carbon monoxide detector is powerable by a/c current and by a battery and comprises a sensor for sensing the presence of carbon monoxide connected to an audible alarm signal. The transmitter comprises means for communicating signals from the carbon monoxide detector and smoke detector to a remote location. The invention further comprises an emergency lighting system connected to the carbon monoxide detector and smoke detector. The light system is powered by a battery and adapted to turn on in the event of a power failure, a signal from the smoke detector or a signal from the carbon monoxide detector. The lighting system can also be used as a night light. A portable receiver receives signals from the transmitter and broadcasts the signals to alert an individual monitoring the conditions to the presence of smoke or carbon monoxide.

U.S. Pat. No. 5,867,105

Inventor: William F. Hajel

Issued: Feb. 2, 1999

A wireless alarm system for generating alarm signals discernible to the hearing impaired. The system includes a detection unit having a smoke or carbon dioxide detector which generates a signal upon sensing the occurrence of smoke or carbon dioxide. A transmitter in the detector unit generates a wirelessly transmitted signal. A receiving unit worn on the body of a person includes a receiver and receives the signal generated by the transmitter. An alarm in the form of a vibrator is coupled with the receiver and generates a vibration discernible to the body of the user. A second alarm operates, or not, depending on whether the person acknowledges the vibrator.

SUMMARY OF THE PRESENT INVENTION

The present invention relates generally to alarms and, more specifically, to a smoke alarm including an emergency light for lighting an escape path and able to communicate with both a lighting system for directing persons to an exit and a vibrating device to be held by a person within the structure being monitored by the alarm, the light system and vibrator device being activated upon sensing of an alarm condition.

A primary object of the present invention is to provide an alarm system that will overcome the shortcomings of prior art devices.

Another object of the present invention is to provide an alarm system which is able to detect an emergency condition within a structure or area being monitored.

A yet further object of the present invention is to provide an alarm system wherein the system includes a vibrating device to be retained by a user, the vibrating device being activated upon detection of an emergency condition for alerting the user.

A still further object of the present invention is to provide an alarm system including a lighting system able to provide a lighted exit path upon detection of an emergency condition.

A further object of the present invention is to provide an alarm system wherein the vibrating device includes a receiver for receiving emergency signals from a centrally located detection device.

Another object of the present invention is to provide an alarm system wherein the vibrating device aids hearing impaired persons in being alerted to the existence of an emergency condition.

Another object of the present invention is to provide an alarm system that is simple and easy to use.

A still further object of the present invention is to provide an alarm system that is economical in cost to manufacture.

Additional objects of the present invention will appear as the description proceeds.

An alarm system for alerting persons within a monitored area as to an emergency situation is disclosed by the present invention. The alarm system includes a monitoring unit strategically placed within said monitored area, a vibrating unit and alighting system. The monitoring unit includes a sensor for sensing conditions within the monitored area and generating a sensor signal, a processor for analyzing the sensor signal to determine if an emergency situation exists and a transmitter for transmitting an emergency signal upon a determination that an emergency situation exists by the microprocessor The vibration unit is retained by a person within the monitored area including a receiver for receiving the emergency signal and a vibrator activated by the receiver for causing the vibrating unit to vibrate thereby alerting the person retaining the vibrating unit as to the emergency situation. The light system is positioned within the monitored area for receiving the emergency signal and illuminating a path to safety for persons within the monitored area. The monitoring unit can also include an audible alarm generator for generating an audible alarm signal and an LED connected to said microprocessor for generating a visual alarm signal upon a determination by the microprocessor that an emergency situation exists.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
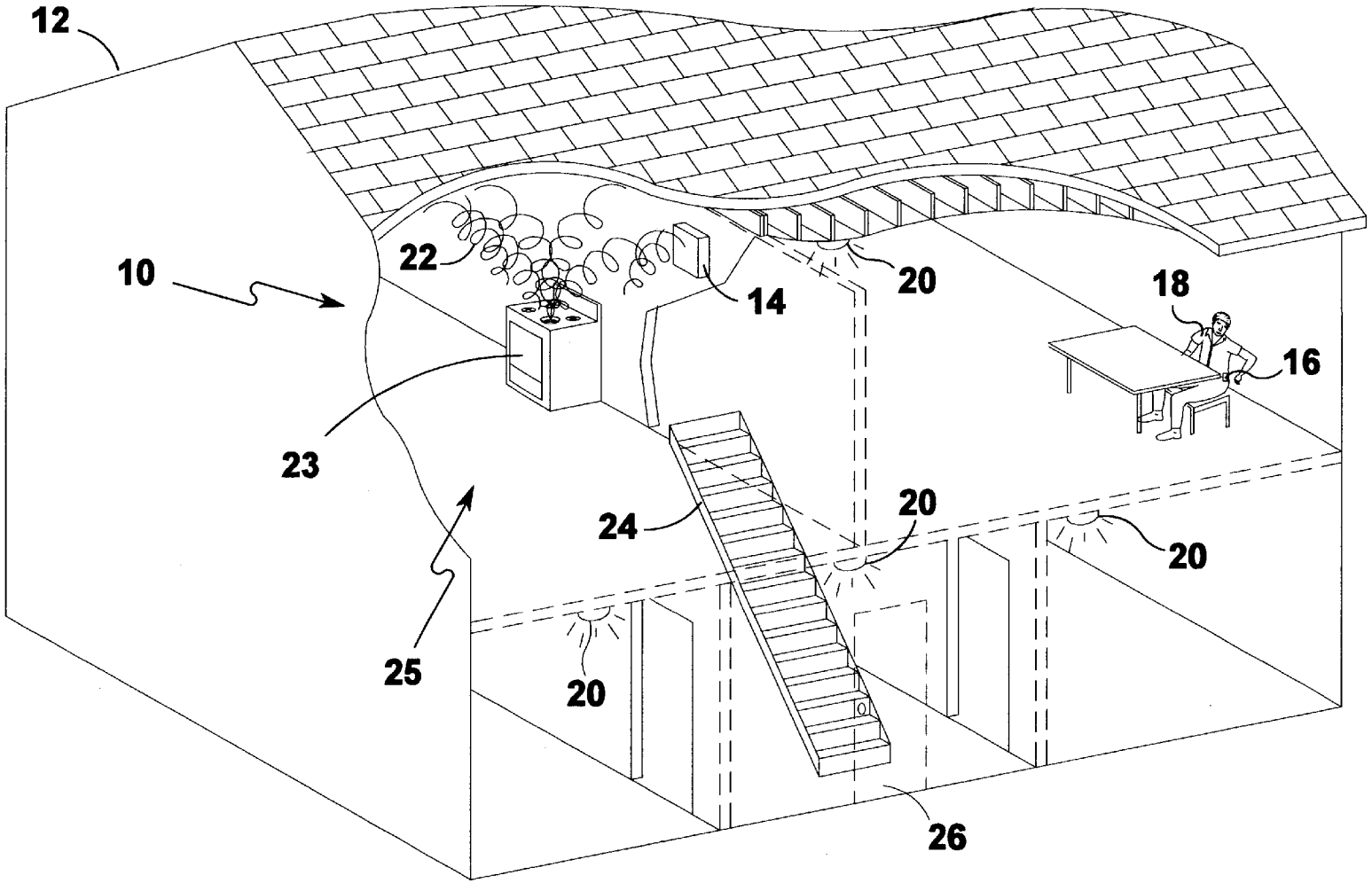
FIG. 1 is a top perspective view of the alarm system of the present invention.

Turning now descriptively to the drawings, in which similar reference characters denote similar elements throughout the several views, the Figures illustrate the alarm system of the present invention. With regard to the reference numerals used, the following numbering is used throughout the various drawing figures.

10 alarm system of the present invention
12 structure housing alarm system
14 detection unit
16 vibration unit
18 person wearing vibration unit
20 light in light system
22 smoke
23 stove
24 stairway within structure
25 kitchen area
26 exit door
28 sensor in detection unit
30 power switch of detection unit
32 LED of detection unit
34 reset switch of detection unit
36 audible alarm of detection unit
38 message display of vibration unit
40 LED of vibration unit
42 power switch of vibration unit
44 clip of vibration unit
46 processor of detection unit
47 power source of detection unit
48 transmitter of detection unit
50 processor of vibration unit
52 power source of vibration unit
54 reset button of vibration unit
56 receiver of vibration unit
58 vibrator of vibration unit
60 light
62 power source connected to light
64 power switch for light
66 receiver connected to activate power switch for light
68 reset button for power switch for light

DETAILED DESCRIPTION OF THE PREFERRED EMBODIMENT

Turning now descriptively to the drawings, in which similar reference characters denote similar elements throughout the several views, FIGS. 1 through 6 illustrate the alarm system of the present invention indicated generally by the numeral 10.

The alarm system 10 is illustrated in FIG. 1 installed within a structure 12. The alarm system 10 includes at least one strategically positioned detection unit 14 and a vibration unit 16 which is retained by a person 18 within the structure 12. The vibration unit 16 is preferably retained by a person 18 with hearing difficulties. Thus, a person 18 within the structure 12 who is unable to hear an audible alarm signal may be alerted to the detection of an emergency situation.

The detection unit 14 is also connected to the light system 20 within the structure 12 and is thereby able to light a path to safety for persons 18 within the structure 12 to follow upon detection of an emergency by the detection unit 14.

The detection unit 14 in this figure is shown detecting the presence of smoke 22 coming from a stove 23 within a kitchen area 25 of the structure 12. Upon detection of the smoke 22 reaching a level of concern indicative of a fire, the detection unit 14 will trigger the lighting system within the structure to illuminate and thus light the stairway 24 and hallways providing a path for persons 18 within the structure 12 to follow to safety through an exit doorway 26. The detection unit 14 will also transmit a signal to the vibration unit 16 causing the vibration unit 16 to vibrate. When the vibration unit 16 is caused to vibrate, the person 18 retaining the vibration unit 16 is alerted to the detection of the alarm situation and can take the appropriate measures to find safety.

Figure 2:
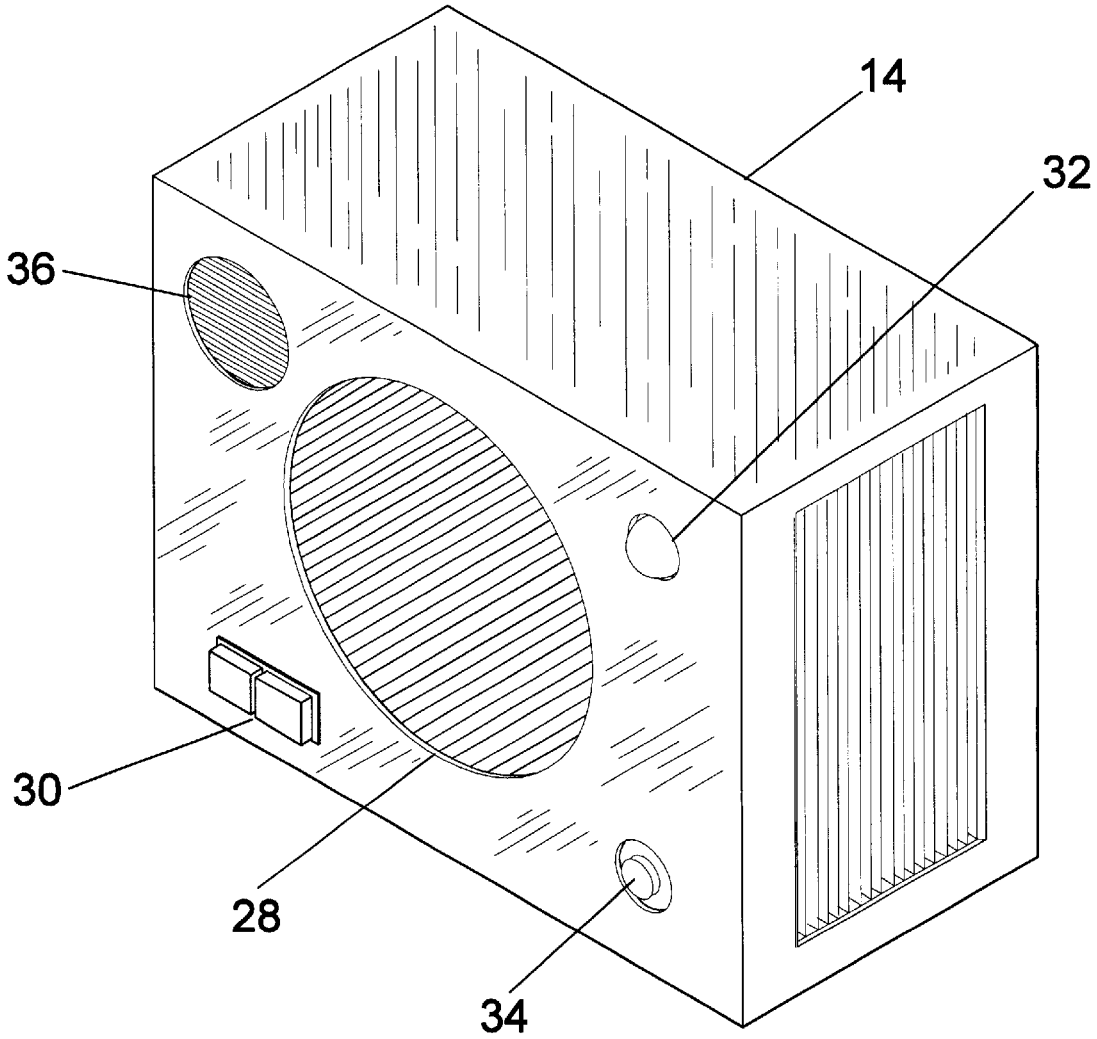
FIG. 2 is a face view of the detection device of the alarm system of the present invention.

A perspective view of the detection unit 14 is illustrated in FIG. 2. As can be seen from this figure, the detection unit 14 includes a sensor 28 for monitoring the designated area for an emergency situation. The sensor 28 may monitor for any type of emergency situation such as smoke, fire, unauthorized entry into the designated area, movement in the designated area, any type of hazardous chemical, etc. A power switch 30 is also provided for manually turning the detection unit 14 "on" or "off".An LED 32 is provided to indicate detection of an emergency situation by the sensor 28. The LED 32 will illuminate upon detection of an emergency situation by the sensor 28. A reset switch 34 is provided for resetting the detection unit 14 after detection of an emergency situation by the sensor 28. When it is determined that the emergency situation is either a false alarm or is under control, activation of the reset button 34 will return the detection unit 14 to the monitoring state. An audible alarm 36 is provided for generation of an audible alarm signal to alert persons within the vicinity of the monitored area to the detection of an emergency situation by the sensor 28. When the sensor 28 detects an emergency situation, the audible alarm 36 is triggered to generate an audible signal indicating the detection of the emergency situation. Activation of the reset button 34 will also reset the audible alarm 36.

While a preferred structure for the sensor 28 is shown and described herein, those of ordinary skill in the art who have read this description will appreciate that there are numerous other structures for the sensor 28 and, therefore, as used herein the phrase "sensor means for sensing for the presence of an emergency situation" should be construed as including all such structures as long as they achieve the desired result of sensing for the presence of an emerging situation, and therefore, that all such alternative mechanisms are to be considered as equivalent to the one described herein.

Figure 3:
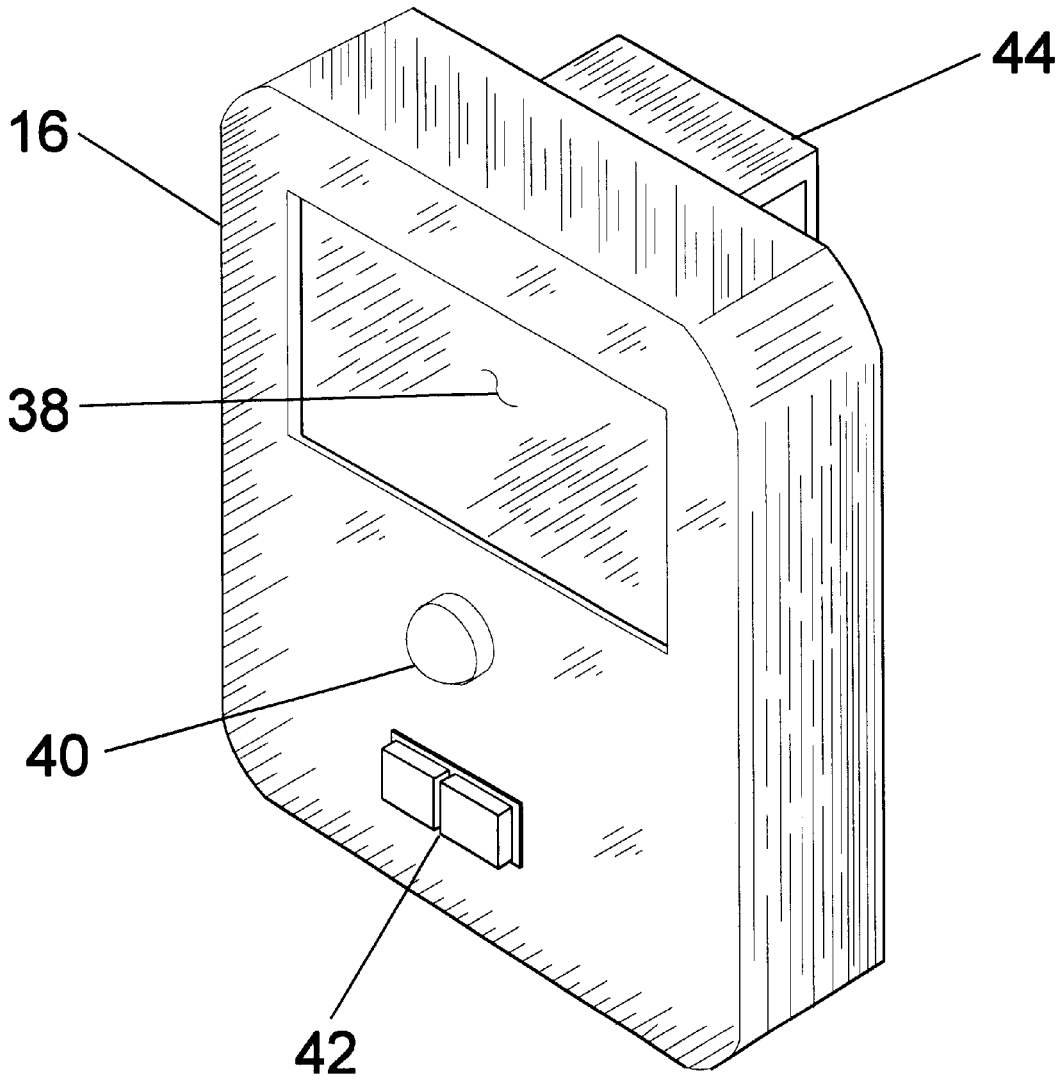
FIG. 3 is a perspective view of the vibration device used with the alarm system of the present invention.

A front perspective view of the vibration unit 16 is illustrated in FIG. 3. As can be seen from this figure, the vibration unit 16 includes a message display screen 38 on a front side thereof. The message display screen 38 provides the user with a display message indicative of the emergency situation detected. The message display 38 may also provide certain general information such as the current time and date. A LED 40 is also provided on the vibration unit 16 for providing a visual indication to the user. The LED 40 may indicate a battery power situation, wherein the LED 40 is illuminated when the battery power is low. Alternatively, the LED 40 may illuminate when the vibration unit 16 receives an emergency signal from the detection unit 14. A power switch 42 is provided for turning the vibration unit 16 "on or "off". The vibration unit 16 need not be active when transported by the user outside the area being monitored and thus the battery power can be conserved by turning the vibration unit 16 "off" upon leaving the monitored area. A clip 44 is provided on a back side of the vibration unit 16 for use in attaching the vibration unit 16 to an article of clothing of the person retaining the unit 16.

Figure 4:
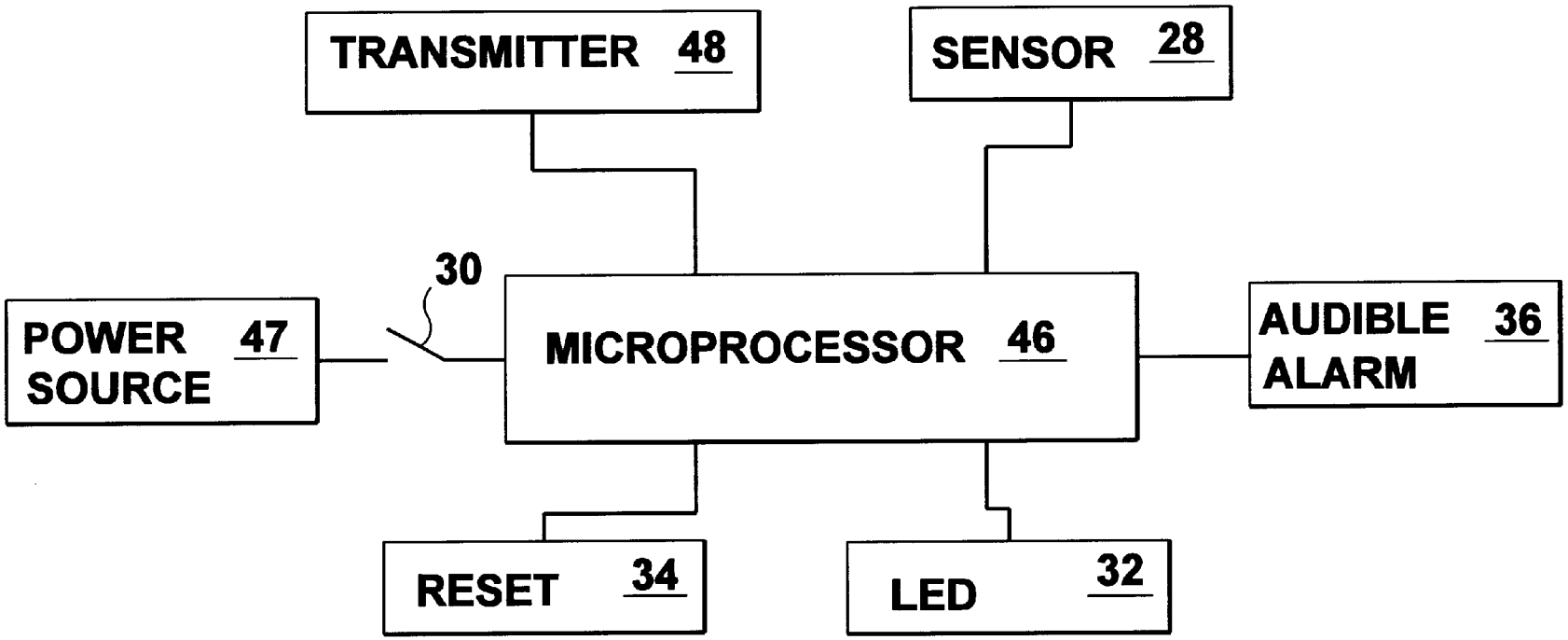
FIG. 4 is a block diagram of the detection device used with the alarm system of the present invention.

A block diagram of the detection unit 14 is illustrated in FIG. 4 illustrating the internal components of the detection unit 14. As can be seen from this figure, the detection unit 14 includes a microprocessor 46. A source of power 47 is connected to the microprocessor 46 via the power switch 30. The power source 47 may either be an internal battery or an external source connected to the detection unit 14 via an electrical connector. The power switch acts to connect or disconnect the power source 48 from the microprocessor 46 thus turning the detection unit 14 "on" or "off". The sensor 28 is connected to provide signals indicative of sensed conditions surrounding the detection unit 14 to the microprocessor 46. The microprocessor 46 will analyze these signals and determine if an emergency condition exists. The LED 32 and audible alarm 36 are also connected to the microprocessor 46. Upon a determination by the microprocessor 46 that an emergency situation exists, the LED 32 is caused to be illuminated and the audible alarm 36 is triggered to generate an audible alarm signal. A transmitter 48 is connected to the microprocessor 46. Upon detection of an emergency situation, the processor 46 triggers the transmitter 48 to generate and transmit an emergency signal to both the vibration unit 16 and to the lighting system 22 of the structure 12. The emergency signal will activate the vibration unit 16 to vibrate and the lighting system 22 to illuminate the lights of the structure 12 and thereby provide a path for persons within the structure 12 to follow out of the structure and to safety. The reset button 34 is provided for resetting the detection unit 14 after detection of an emergency situation by the sensor 28. When it is determined that the emergency situation is either a false alarm or is under control, activation of the reset button 34 will return the detection unit 14 to the monitoring state.

Figure 5:
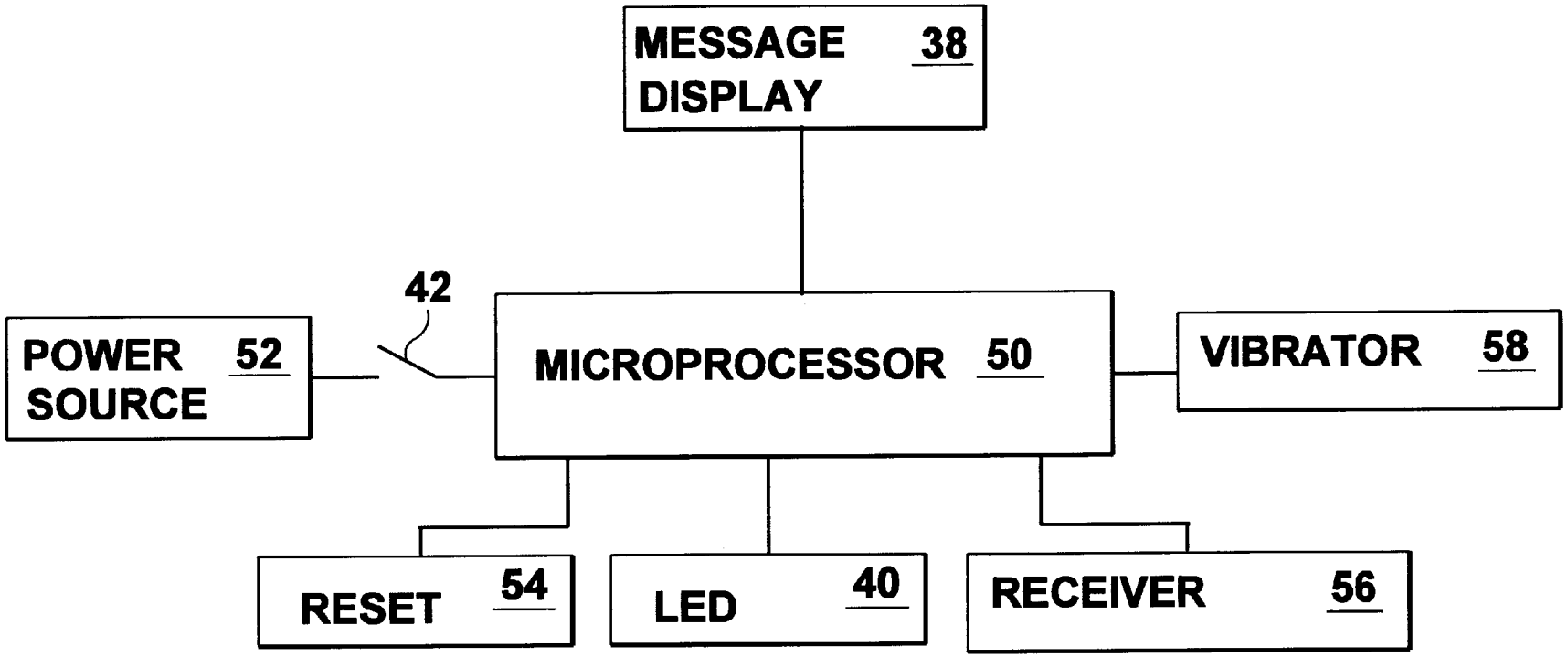
FIG. 5 is a block diagram of the vibration device used with the alarm system of the present invention.

A block diagram of the vibration unit 16 is illustrated in FIG. 5. As can be seen in this figure, the vibration unit 16 includes a microprocessor 50. The microprocessor 50 is connected to a source of power 52 via the power switch 42. The power source 52 is preferably an internal battery housed within the vibration unit 16 thus allowing the vibration unit 16 to be mobile and able to move readily with the person retaining the unit 16. The power switch acts to connect or disconnect the power source 52 from the microprocessor 50 thus turning the vibration unit 16 "on" or "off".The LED 40 is provided connected tot he microprocessor 50 for indicating when the battery power is low and the battery should be replaced. A receiver 56 is connected to the microprocessor 50 and is provided for receiving emergency signals transmitted by the transmitter 48 of the monitoring unit 14. Upon receipt of the emergency signal from the monitoring unit 14, the receiver 56 will send the signal to the microprocessor 50 for analysis. The message display 38 and a vibrator 58 are connected to the microprocessor 50. When the microprocessor 50 determines that an emergency signal has been received by the receiver 56, the microprocessor will cause the message display 38 to display a message indicative of the emergency situation and the vibrator 58 will begin to vibrate. The vibration produced by the vibrator 58 will alert the person who is carrying the vibration unit 16 that an emergency situation has been detected. Thus, a hearing impaired person who is unable to hear the audible alarm signal generated by the monitoring unit 14 can be alerted to the emergency situation by the vibration unit 16. Upon detecting the vibration of the vibrating unit 16, the person carrying the vibration unit 16 can view the display screen 38 to be alerted to the type of emergency situation detected. A reset switch 34 is provided for resetting the vibrating unit 16 after the person carrying the vibration unit 16 is alerted to the detection of the emergency situation. When it is determined that the emergency situation is either a false alarm or is under control, activation of the reset button 34 will return the vibration unit 16 to its at rest state until a subsequent emergency signal is received from the detection unit 14.

Figure 6:
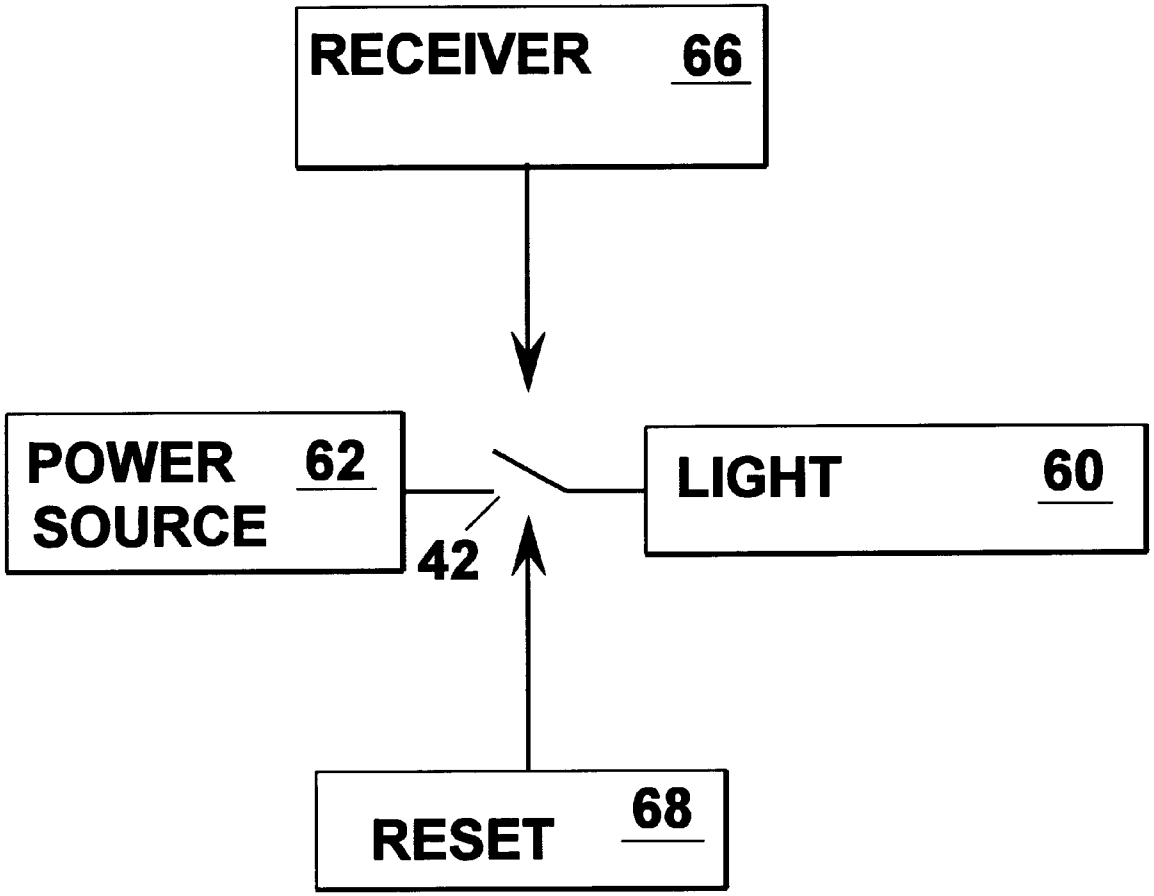
FIG. 6 is a block diagram of the lighting system used with the alarm system of the present invention.

A block diagram illustrating the connection for controlling a light 60 of the lighting system 22 is illustrated in FIG. 6. The lights 60 of the lighting system 22 are each connected to a power source 62 by a switch 64. The power source 62 is preferably the electrical system of the structure 12 and the lights 60 of the lighting system 22 are connected as in any conventional structure 12. A receiver 66 is provided to activate the switch 64 upon receipt of an emergency signal from the detection unit 14. Upon receipt of an emergency signal from the detection unit 14, the receiver 66 will activate the switch 64 to close and thus connect the lights 60 of the lighting system 22 to the power source 62. A reset switch 68 is provided to reset the light system 22 upon a determination that the emergency situation is false or the emergency situation is under control.

The operation of the alarm system 10 will now be described with reference to the figures. In operation, the alarm system 10 is installed in a structure 12 by strategically placing the monitoring device 14 in an area to be monitored. The monitoring device 14 will be positioned so that it is able to monitor the entire area or at least a section of the area to be monitored. If the monitoring device 14 is able to monitor only a section of the monitoring area then additional monitoring devices 14 must be strategically positioned within the area to monitor the entire area. The monitoring device will be adapted to sense for a desired type or types of emergency situation such as smoke, fire, gas, movement, etc.

The light system of the structure will be equipped with a receiver and switch device such that the lights of the light system 22 can be activated by an emergency signal transmitted by the monitoring device 14. The receiver 66 will be able to activate the switch 64 upon receipt of the emergency signal to connect the lights 60 with a power source 62 and thus cause the lights 60 to illuminate and provide a lighted path for egress of the persons within the structure 12.

The vibrating device 16 is preferably retained by a hearing impaired person who is unable to hear an audible alarm generated by the monitoring device 14 upon detection of an alarm situation. The vibrating device 16 and the receiver 66 of the light system 22 are both tuned to receive signals at a frequency at which the transmitter 48 of the monitoring unit 14 transmits the emergency signal.

Once installed, the sensor 28 of the monitoring device 14 will continually sense the monitoring area for indications of an emergency situation. The sensor 28 will provide signals indicative of sensed conditions to the microprocessor 46 for analysis. When the microprocessor 46 determines that an emergency situation exists, the microprocessor will activate the audible alarm generator 36 to generate an audible alarm signal and will activate the LED 32 to illuminate. The microprocessor 46 will also activate the transmitter 48 to generate and transmit an emergency signal.

The emergency signal transmitted by the transmitter 48 of the monitoring unit 14 will be received by the receiver 56 of the vibrating unit 16. The emergency signal will include data indicative of the type of emergency situation detected. The received signal will be provided to the microprocessor 50 of the vibration unit 16 and analyzed. The data included in the emergency signal will be decoded and provided to the message display 38 to display a message indicative of the detected emergency. The microprocessor 50 will also activate the vibrator 58 to start vibrating. The vibrations of the vibrating unit will alert the person carrying the vibration unit that an emergency situation exists and has been detected. The person carrying the vibration unit 16 will then look at the display screen 38 to find out the type of emergency detected.

The emergency signal will also be received by the receiver 66 of the lighting system 22. The receiver 66 will activate the switch 64 to connect the lights 60 of the lighting system 22 to the power source 62 and thus cause the lights to illuminate. The illuminated lights 60 will form a path for persons in the structure 12 to safety outside of the monitoring area.

When the emergency situation is under control or has been determined to be a false detection, the reset button 34 on the monitoring unit 14 is pressed to reset the monitoring unit 14 and thus halt the generation of the audible alarm signal and turn off the LED 32. The reset button 54 on the vibration unit 16 is also pressed to halt the vibrating of the vibration unit 16 and erase the emergency message on the display screen 38. The reset button 68 on the lighting system 22 is also pressed to disconnect the lights 60 from the power source 62 and return the lighting system 22 to normal operation. Upon detection of another emergency situation the above will be repeated to alert persons within the monitoring area to the emergency.

From the above description it can be seen that the alarm system of the present invention is able to overcome the shortcomings of prior art devices by providing an alarm system which is able to detect an emergency condition within a structure or area being monitored. The alarm system includes a vibrating device to be retained by a user, the vibrating device being activated upon detection of an emergency condition for alerting the user, a lighting system able to provide a lighted exit path upon detection of an emergency condition. The vibrating device of the alarm system includes a receiver for receiving emergency signals from a centrally located detection device and is preferably provided for alerting hearing impaired persons as to the existence of an emergency condition. Furthermore, the alarm system of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An alarm system for alerting persons within a monitored area as to an emergency situation, said alarm system comprising:

a) a monitoring unit strategically placed within said monitored area, said monitoring unit including:

i) a sensor for sensing conditions within the monitored area and generating a sensor signal;

ii) a microprocessor for analyzing said sensor signal to determine if an emergency situation exists; and iii) a transmitter for transmitting an emergency signal upon a determination that an emergency situation exists by said microprocessor;

b) a vibration unit to be retained by a person within the monitored area for receiving said emergency signal and causing said vibrating unit to vibrate thereby alerting the person retaining the vibrating unit as to the emergency situation; and c) a light system positioned within the monitored area for receiving said emergency signal and illuminating a path to safety for persons within the monitored area.

2. The alarm system as recited in claim 1, wherein said monitoring unit further includes an audible alarm generator connected to said microprocessor for generating an audible alarm signal upon a determination by said microprocessor that an emergency situation exists.

3. The alarm system as recited in claim 2, wherein said monitoring unit further includes an LED connected to said microprocessor for generating a visual alarm signal upon a determination by said microprocessor that an emergency situation exists.

4. The alarm system as recited in claim 3, wherein said monitoring unit further includes a reset button connected to reset said microprocessor upon determining that a detected emergency situation is either a false signal or under control and no longer a threat.

5. The alarm system as recited in claim 4, wherein activation of said reset button causes said audible alarm to cease generation of said audible alarm signal and turns off said LED.

6. The alarm system as recited in claim 1, wherein said sensor senses for at least one of smoke, fire, motion, and gas.

7. The alarm system as recited in claim 6, wherein said emergency signal includes a data indicative of the type of emergency detected.

8. The alarm system as recited in claim 1, wherein said vibrating unit further includes a display screen for displaying said data signal for informing a person viewing the display screen as to the type of emergency detected.

9. The alarm system as recited in claim 8, wherein said vibrating unit further includes a reset button connected to cease vibration of the vibrating unit upon determining that a detected emergency situation is either a false signal or under control and no longer a threat.

10. The alarm system as recited in claim 9, wherein said vibrating unit further includes an internal power source and a power indicator LED for indicating a low power level for said power source.

11. The alarm system as recited in claim 1, wherein said light system further includes a reset button connected to deactivate the lights of the light system upon determining that a detected emergency situation is either a false signal or under control and no longer a threat.

12. An alarm system for alerting persons within a monitored area as to an emergency situation, said alarm system comprising:

b) a monitoring unit strategically placed within said monitored area, said monitoring unit including:

iv) a sensor for sensing conditions within the monitored area and generating a sensor signal;

v) a microprocessor for analyzing said sensor signal to determine if an emergency situation exists; and vi) a transmitter for transmitting an emergency signal upon a determination that an emergency situation exists by said microprocessor;

b) a vibration unit to be retained by a person within the monitored area for receiving said emergency signal and causing said vibrating unit to vibrate thereby alerting the person retaining the vibrating unit as to the emergency situation; and c) a light system positioned within the monitored area for receiving said emergency signal and illuminating a path to safety for persons within the monitored area.

13. The alarm system as recited in claim 12, wherein said light system further includes a reset button connected to deactivate the lights of the light system upon determining that a detected emergency situation is either a false signal or under control and no longer a threat.

14. The alarm system as recited in claim 12, wherein said monitoring unit further includes an audible alarm generator connected to said microprocessor for generating an audible alarm signal upon a determination by said microprocessor that an emergency situation exists.

15. The alarm system as recited in claim 14, wherein said monitoring unit further includes an LED connected to said microprocessor for generating a visual alarm signal upon a determination by said microprocessor that an emergency situation exists.

16. The alarm system as recited in claim 15, wherein said monitoring unit further includes a reset button connected to reset said microprocessor upon determining that a detected emergency situation is either a false signal or under control and no longer a threat.

17. The alarm system as recited in claim 16, wherein activation of said reset button causes said audible alarm to cease generation of said audible alarm signal and turns off said LED.

18. The alarm system as recited in claim 12, wherein said sensor senses for at least one of smoke, fire, motion, and gas.

19. The alarm system as recited in claim 18, wherein said emergency signal includes a data indicative of the type of emergency detected.

20. The alarm system as recited in claim 12, wherein said vibrating unit further includes a display screen for displaying said data signal for informing a person viewing the display screen as to the type of emergency detected.

21. The alarm system as recited in claim 20, wherein said vibrating unit further includes a reset button connected to cease vibration of the vibrating unit upon determining that a detected emergency situation is either a false signal or under control and no longer a threat.

22. The alarm system as recited in claim 21, wherein said vibrating unit further includes an internal power source and a power indicator LED for indicating a low power level for said power source.

* * * * *